US006309122B1

(12) United States Patent
Wang

(10) Patent No.: US 6,309,122 B1
(45) Date of Patent: Oct. 30, 2001

(54) LOCATING STRUCTURE FOR A BOUNCE DEVICE IN A PEN

(75) Inventor: Thomas Wang, Taipei (TW)

(73) Assignee: Excel Rite Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/729,818

(22) Filed: Dec. 6, 2000

(30) Foreign Application Priority Data

Feb. 3, 2000 (TW) ..... 89202072 U

(51) Int. Cl.[7] ..... B43K 5/16
(52) U.S. Cl. ..... 401/112; 401/109
(58) Field of Search ..... 401/99, 109, 112, 401/117, 104

(56) References Cited

U.S. PATENT DOCUMENTS 2,530,901 * 11/1950 Nichols ..... 401/112
3,657,812 * 4/1972 Lee ..... 401/112
5,048,989 * 9/1991 Stageman ..... 401/109
5,599,122 * 2/1997 Yu ..... 401/99

* cited by examiner

*Primary Examiner*—David J. Walczak
(74) *Attorney, Agent, or Firm*—Dougherty & Troxell

(57) ABSTRACT

A locating structure for a bounce device in a pen, having a hollow penholder, a locating device, and a center stick. The penholder has an end with a transverse guide groove and a locating hole below the guide groove. The locating hole has a size greater than the guide groove. The locating device has a slide block with a lateral locating hole, a pushbutton with a spring locating at a bottom and received in the locating hole, a slide block inserted into the penholder through the opening. The pushbutton has a stepped end shape providing a slide tenon and a stop ring corresponding to the guide groove and the locating hole respectively, and also providing a stop flange having a size greater than the locating hole. When the pushbutton is pushed to move the slide tenon downward along the guide groove, the spring urges the stop ring to fit with the locating hole. Thus, the slide block has the writing part extend outward from the penholder. When the slide tenon is pressed and the pushbutton moves inward in the locating hole, the writing part retreats in the penholder.

9 Claims, 3 Drawing Sheets

LOCATING STRUCTURE FOR A BOUNCE DEVICE IN A PEN

BACKGROUND OF THE INVENTION

1. Field of the Invention

The present invention relates to a locating structure for a bounce type of pen, and particularly to a locating structure for a bounce device of center stick in a pen, with which the center stick can move inward as further as possible to avoid the clothes being stained with ink.

2. Description of Related Art

A pen has been used for writing or drawing since very early years. Due to the progress of business and industry and the development of technology, the pen has been presented with multiple aspects accordingly. Therefore, there are pens in different structures and operation ways. For instance, a traditional pen has the writing part thereof be detachably fitted with a cap or be rotated or pushed to move inward or outward.

Regardless the progressive development of the pen, there is a problem of being stained by the ink always bothering the user. That is, there is no an effective solution to overcome the problem of ink staining. The ink may leak out to stain the clothes or the document occasionally while the pen is in a state of not being in use. Of course, the problem of ink staining occurs mostly because of an improper operation of pen resulting in an exposed writing part thereof. Taking the known pen with bounce device as an example, the bounce device is usually provided with a structure of push part or lock part. However, the structure has a defect that the outer end of the penholder thereof much closer to the writing part while the pen is not in use and the center stick thereof is in a state of moving backward. When the pen is dipped to a pocket on the clothes, the floss or the fiber in the pocket is easy to adhere to the writing part so as to be stained with the ink due to capillary phenomenon. Especially, the damped center stick used in the pen with steel ball nib is much easier to result in the ink staining of capillary action. This is why the pen with bounce device is seldom to use the damped center stick with steel ball nib.

SUMMARY OF THE INVENTION

An object of the present invention is to provide a locating structure for a bounce device in a pen, with which the writing part of the center stick in the pen may move further inward the penholder to avoid the clothes or the document being stained with the ink effectively.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
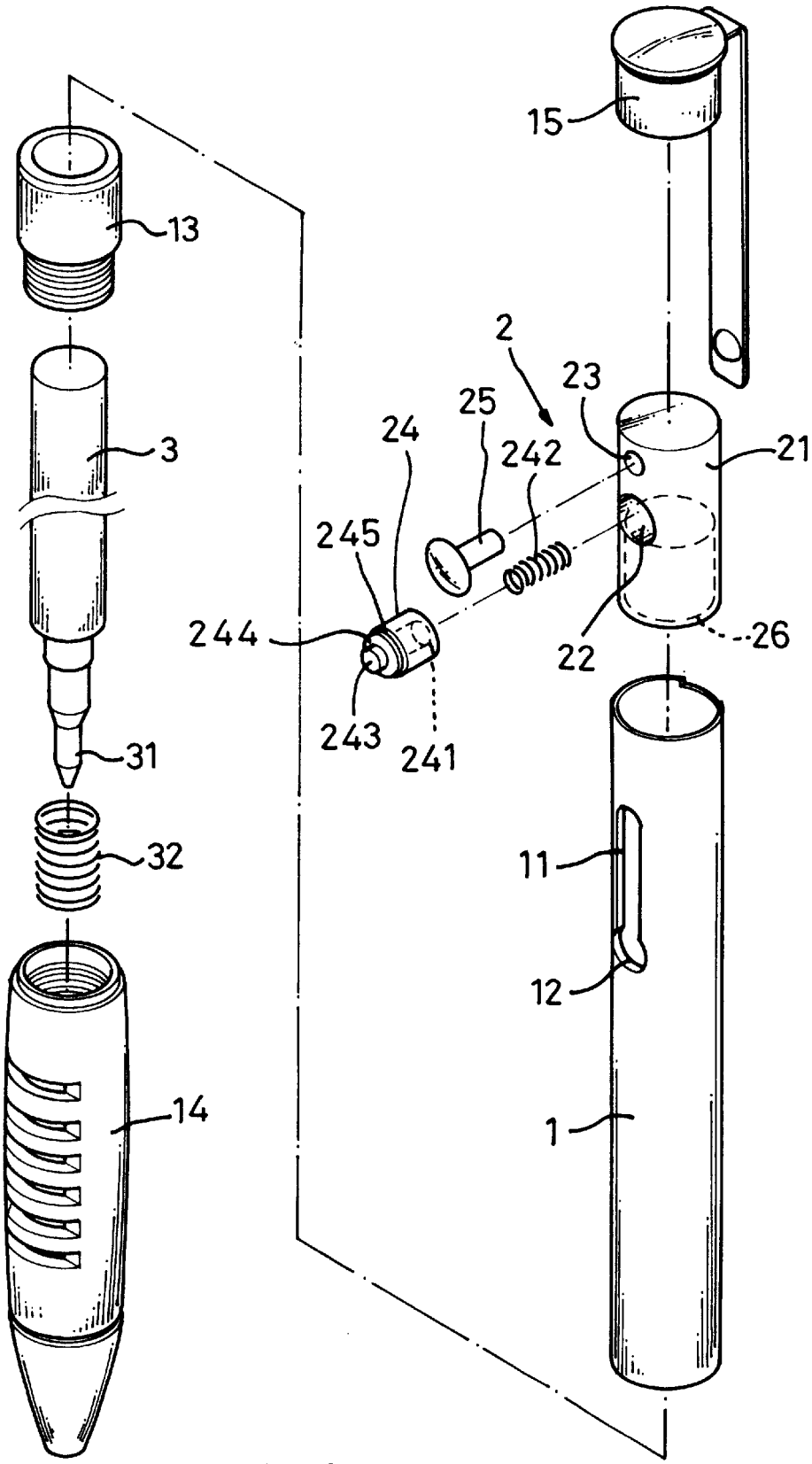
FIG. 1 is a disassembled perspective view of a locating structure for a bounce device in a pen according to the present in invention.

Referring to FIGS. 1 to 4, a locating structure for a bounce device in a pen according to the present invention basically comprises a penholder 1, a locating device 2, and a center stick 3.

The penholder 1 is a shape of elongated tubing to receive the center stick 3 and at the top thereof has a transverse guide groove 11. The guide groove 11 at the bottom thereof has a locating hole 12 providing a larger size. A held part 14 joins an intermediate cylinder 13 after the cylinder 13 fits with the penholder 1. An opening at the top of penholder 1 is enclosed by way of a clip cap 15 so as to be carried by the user.

The locating device 2 has a cylindrical slide block 21 with a lateral receiving hole 22 for receiving a push button 24 and the push button 24 at the bottom thereof has a locating hole 241 containing a spring 242. Thus, the slide block 21 may be inserted into the penholder 1 from the upper opening thereof after the pushbutton 24 together with the spring 242 is inserted in the receiving hole 22. The pushbutton 24 has a stepped end with a slide tenon 243 and a stop ring 244 corresponding to the guide groove 11 and the locating hole 12 respectively and is provided with a stop flange 245 having a size greater than the locating hole 12. In addition, a fitting hole 23 is provided above the receiving hole 22 for a press button 25 fitting with the fitting hole 23 through the guide groove 11 for the pressing operation. The press button 25 has a length greater than the pushbutton 24. Furthermore, the slide block 21 at the bottom thereof may be provided with a center bore 26 for fitting with the top part of the center stick 3 to constitute a linking movement.

The center stick 3 is a prior art and an end thereof is inserted into the center bore 26 and another end thereof for writing is surrounded with a spring 32 and received in the held part 14 of the penholder 1. Moreover, the center stick for the steel ball nib is preferably used as said center stick 3.

Figure 3:
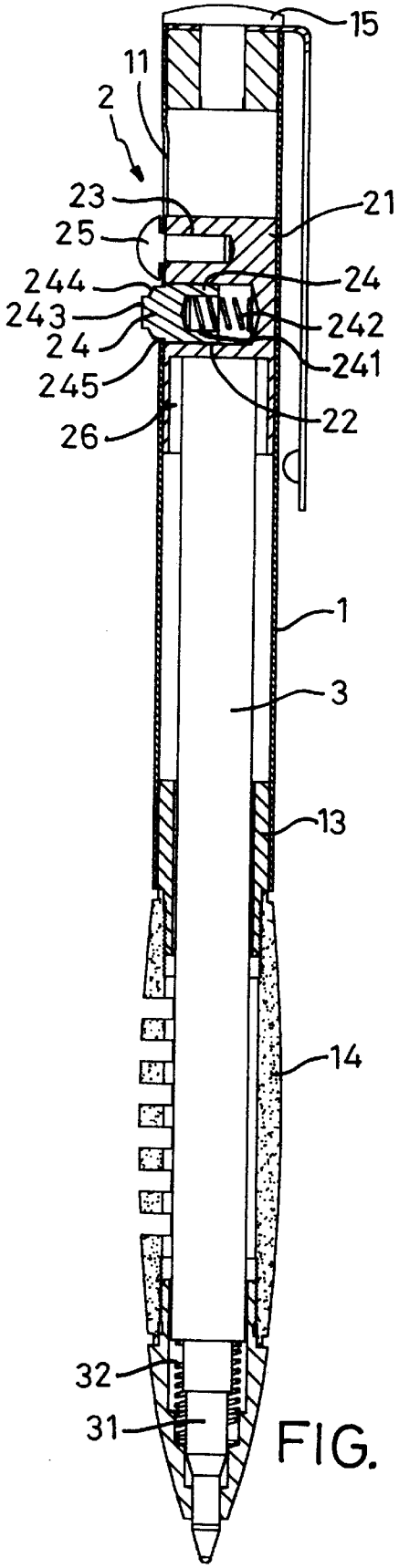
FIG. 3 is a sectional view similar to FIG. 2 illustrating in a state of the bounce device having been pushed.
Figure 2:
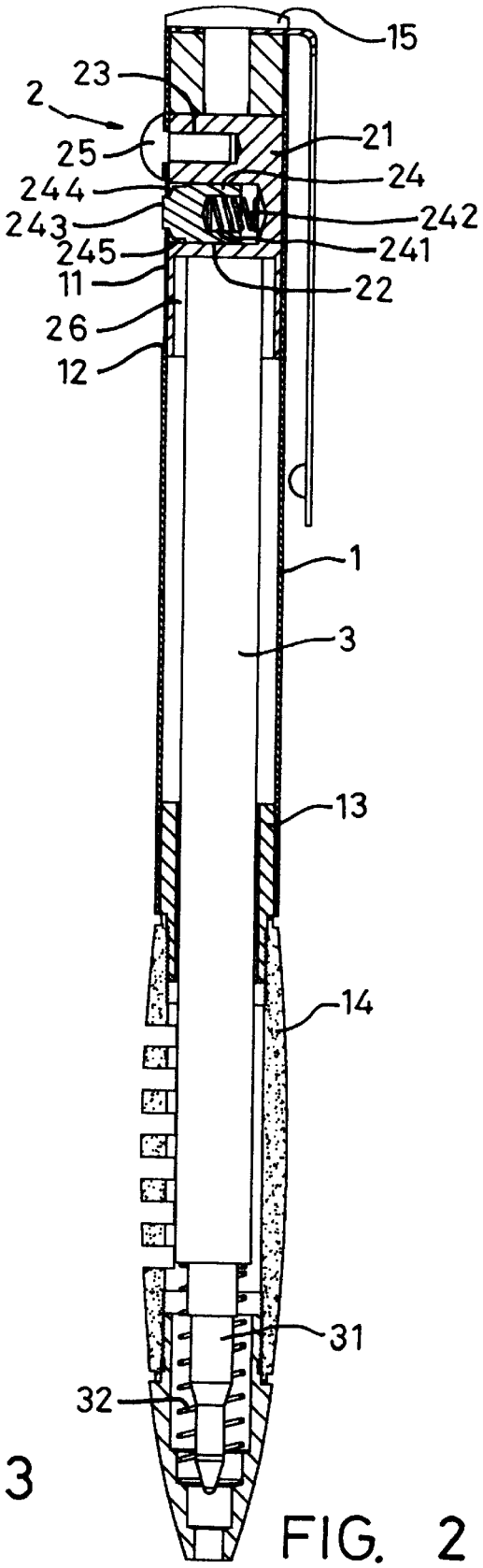
FIG. 2 is a plan sectional view of FIG. 1 after assembly illustrating in a state of the bounce device being not pushed.
Figure 4:
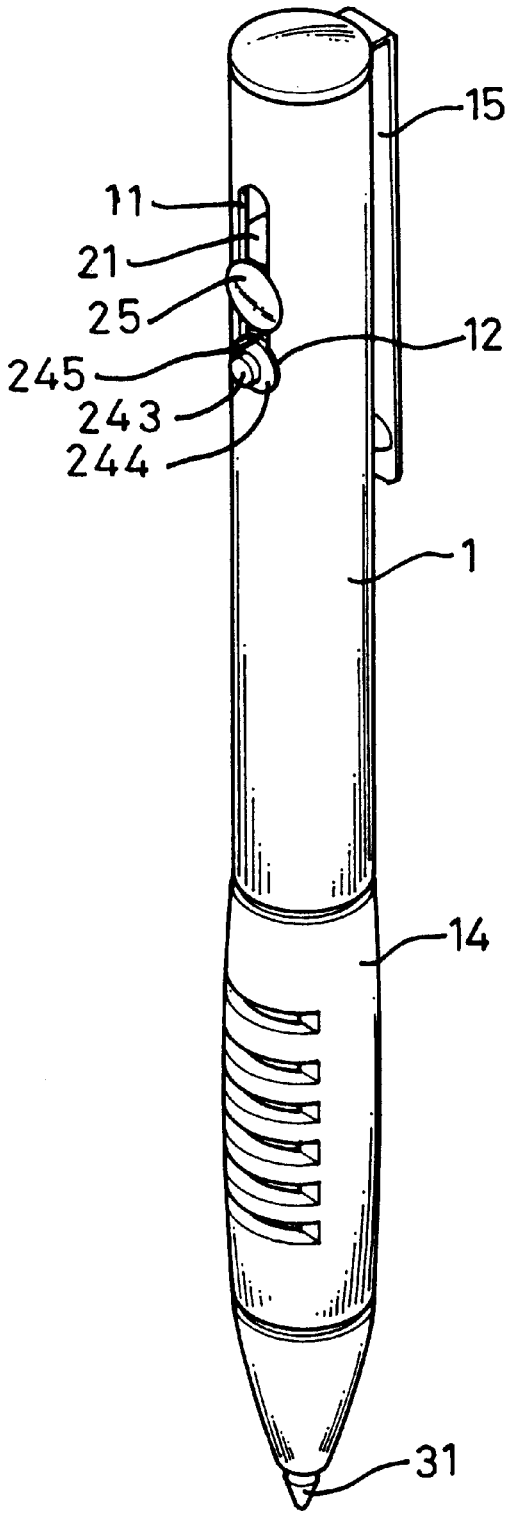
FIG. 4 is a assembled perspective view of the locating structure for a bounce device in a pen according to the present in invention.

Referring to FIGS. 2 and 3, the press button 25 is pushed first once the pen is going to be written. Then, the guide tenon 243 at the top of the pushbutton 24 displaces along the guide 11 with the stop ring 244 pressing against the inner wall of the guide groove 11. Due to the stop ring 244 being the same diameter as the locating hole 12, the stop ring 244 may move into and fit with the locating hole 12 by way of the spring 242 stretching outward. Hence, the pushbutton 24 is not possible to release from the locating hole 12 because of the stop flange 245 next to the stop ring 244 being pressed against the locating hole 12. Thus, the slide block 21 can be fixed in the penholder 1 and keeps in a state of being pressed as shown in FIGS. 3 and 4. When the pen is not used for writing, the slide tenon 243 is pressed to push the pushbutton 24 moving inward toward the receiving hole 22 such that the stop ring 244 moves away the locating hole 12. In this way, the spring 32 surrounding the center stick 3 may stretch to urge the slide block 21 moving back to the original position thereof as shown in FIG. 2.

It can be understood from the preceding description of the preferred embodiment that the writing part 31 on the center stick 3 has a displacement thereof moving inwardly of the penholder 1 which can be possibly changed by way of a change of guide groove 11. Therefore, even if a damped center stick for steel ball nib is used in the present invention, the clothes being stained with the ink via the floss or the fiber can be avoided effectively. Besides, the special locating structure disclosed in the present invention is substantially different from the prior art in not only the arranged components thereof but also the operation way thereof.

While the invention has been described with reference to preferred embodiment thereof, it is to be understood that modifications or variations may be easily made without departing from the spirit of this invention, which is defined by the appended claims.

What is claimed is:

1. A locating structure for a bounce device in a pen, comprising:

a hollow penholder with two ends, a first end thereof having an opening, being provided with a transverse guide groove, and a locating hole being provided below the guide groove and having a size greater than the guide groove;

a locating device, further comprising a slide block with a lateral receiving hole, a pushbutton with a first spring located in the receiving hole, the slide block being inserted into the penholder through the opening, said pushbutton having a stepped shape at an end thereof, providing a slide tenon and a stop ring corresponding to the guide groove and the locating hole respectively, and providing a stop flange having a size greater than the locating hole;

a center stick with a first end thereof connecting with the slide block and a second end thereof being a writing part surrounded by a second spring;

whereby when the pushbutton is pushed to move the slide tenon downward along the guide groove, the first spring is in a state of stretching and urges the stop ring to fit with the locating hole such that the slide block is located to have the writing part extending outwardly from the penholder; when the slide tenon is pressed and the pushbutton moves inward in the receiving hole to have the stop ring moving away the locating hole, the second spring is in a state of stretching to restore the slide block to an original position thereof such that the writing part retreats in the penholder.

2. The locating structure for a bounce device in a pen according to claim 1, wherein a fitting hole is provided above the receiving hole and a press button is inserted in the fitting hole through the slide groove for being pressed.

3. The locating structure for a bounce device in a pen according to claim 2, wherein the press button has a length greater than the pushbutton.

4. The locating structure for a bounce device in a pen according to claim 1, wherein the writing part has an inward displacement depending on a length of the guide groove.

5. A locating structure for a bounce device in a pen according to claim 1, wherein the slide block at a bottom thereof has a center bore to engage with the end of the center stick.

6. A locating structure for a bounce device in a pen according to claim 1, wherein the pushbutton at the bottom thereof has a second locating hole to receive the first spring.

7. The locating structure for a bounce device in a pen according to claim 1, wherein an intermediate cylinder is provided to engage with a second end of the penholder and a held part is joined to the intermediate cylinder.

8. The locating structure for a bounce device in a pen according to claim 1, wherein a clip cap encloses the opening of the penholder.

9. The locating structure for a bounce device in a pen according to claim 1, wherein the center stick for steel ball nib.

* * * * *